US009452438B2

(12) United States Patent
Yamamoto et al.

(10) Patent No.: US 9,452,438 B2
(45) Date of Patent: Sep. 27, 2016

(54) FULL CONE SPRAY NOZZLE

(71) Applicants: NIPPON STEEL & SUMITOMO METAL CORPORATION, Tokyo (JP); SPRAYING SYSTEMS CO., JAPAN, Tokyo (JP)

(72) Inventors: Masaki Yamamoto, Sosa (JP); Yoshihiro Serizawa, Tokyo (JP); Hirokazu Kotake, Tokyo (JP); Isao Yoshii, Tokyo (JP); Ryuuji Yamamoto, Tokyo (JP); Hitoshi Nikaidoh, Tokyo (JP); Satoru Uchijima, Sosa (JP); Hiromitu Kurita, Sosa (JP)

(73) Assignees: NIPPON STEEL & SUMITOMO METAL CORPORATION, Tokyo (JP); SPRAYING SYSTEMS CO., JAPAN, Tokyo (JP)

( * ) Notice: Subject to any disclaimer, the term of this patent is extended or adjusted under 35 U.S.C. 154(b) by 103 days.

(21) Appl. No.: 14/349,943

(22) PCT Filed: Dec. 25, 2012

(86) PCT No.: PCT/JP2012/083515

§ 371 (c)(1),
(2) Date: Apr. 4, 2014

(87) PCT Pub. No.: WO2014/102909

PCT Pub. Date: Jul. 3, 2014

(65) Prior Publication Data

US 2015/0202636 A1 Jul. 23, 2015

(51) Int. Cl.
*B05B 1/34* (2006.01)
*B05B 1/06* (2006.01)
*B21B 45/02* (2006.01)

(52) U.S. Cl.
CPC ..... *B05B 1/06* (2013.01); *B05B 1/341* (2013.01); *B05B 1/3415* (2013.01); *B05B 1/3447* (2013.01); *B21B 45/0233* (2013.01)

(58) Field of Classification Search
CPC ..... B05B 1/3415; B05B 1/3447
USPC ..... 239/403, 488, 463, 467, 472, 494, 497, 239/487
See application file for complete search history.

(56) References Cited

U.S. PATENT DOCUMENTS 3,415,453 A * 12/1968 Costa ..... B05B 1/3447 239/465
4,406,407 A * 9/1983 Aprea ..... B05B 1/3447 239/487

(Continued)

FOREIGN PATENT DOCUMENTS

JP 58-31980 B2 7/1983
JP 2002-542019 A 12/2002
JP 2009-539614 A 11/2009

OTHER PUBLICATIONS

International Search Report dated Apr. 2, 2013, issued in PCT/JP2012/083515 (Form PCT/ISA/210).

*Primary Examiner* — Arthur O Hall
*Assistant Examiner* — Christopher R Dandridge
(74) *Attorney, Agent, or Firm* — Birch, Stewart, Kolasch & Birch, LLP

(57) ABSTRACT

A full cone spray nozzle comprising: a nozzle body (1) having a liquid inlet (3) at its upstream end and a spray orifice (4) at its downstream end; a vane structure (2) of an axial direction length (W) and diameter (D) arranged with its outer circumferential surface in contact with the inside of the nozzle body (1); has a plurality of channel grooves (6) of width (T) and depth (H) at the outer circumferential surface of the vane structure (2); an upstream side projecting part (8) of a length (U) in the axial direction of the nozzle body (1) at an upstream side of the vane structure (2); a downstream side projecting part (9) of a length (P) in the axial direction of the nozzle body (1) at a downstream side of the vane structure (2); and a swirl flow chamber (5) of an axial direction length (L) which is a space formed by an inside wall surface of the nozzle body (1), the vane structure (2) and the spray orifice (4), wherein $0.25 \leq T/D \leq 0.30$, $0.25 \leq H/D \leq 0.30$, and $1.5 \leq L/W \leq 3.5$ are satisfied.

6 Claims, 6 Drawing Sheets

(56) References Cited

U.S. PATENT DOCUMENTS 4,474,331 A 10/1984 Aprea et al.
6,722,585 B1 4/2004 Stradella
2007/0290073 A1* 12/2007 Peterson ..... B05B 1/3415 239/399

* cited by examiner (a)

(b)

FULL CONE SPRAY NOZZLE

TECHNICAL FIELD

The present invention relates to a full cone spray nozzle which for example is used for cooling, washing, etc. in the process of production of steel sheet and sprays a liquid in a full cone shape.

BACKGROUND ART

A "full cone spray nozzle" is a nozzle in which the liquid which is discharged from the nozzle is sprayed in a conical shape. "Full cone" means the droplets of the discharged liquid are filled to the center of the cone.

A full cone spray nozzle generally has a tubular nozzle body inside of which there is a vane structure which has swirl flow generating means. There are various shapes of vane structures, but the liquid which is supplied from the upstream end of the nozzle body passes the vane structure and flows to the downstream end of the nozzle body during which time the swirl flow generating means of the vane structure makes it swirl and form an eddy current.

The liquid which flows to the downstream side of the nozzle body in this way is sprayed from the downstream end of the nozzle body in a full cone shape.

PLT 1 discloses a full cone spray nozzle which has a bore at the center part of the vane structure and is provided with a swirl flow generating means comprised of a plurality of swirl paths which are formed in an inclined direction at the outer circumferential surface of the vane structure. This full cone spray nozzle aims at generating a spray pattern of a uniform flow rate distribution by a wide angle (65 to 75°) with a uniform flow rate distribution.

PLT 2 discloses a full cone spray nozzle which lacks the center bore of the vane structure and makes the vane structure as a whole an X-shape. According to this full cone spray nozzle, it is possible to generate a spray pattern which has a bell-shaped flow rate distribution which has a maximum flow rate at the center of the spray region of a narrow spray angle (about 30° or less).

PLT 3 discloses a nozzle which has channel grooves in an inclined direction at the outer circumference of the vane structure, has a downstream side of the vane structure formed into a cone shape, and ejects a hollow cone shaped spray. A "hollow cone shaped spray" is a spray which is cone shaped at its outside, but does not have droplets of the discharged liquid filled to the center of the cone. Therefore, according to this nozzle, it possible to give a swirl force to a low pressure liquid and generate a fine, stable hollow cone spray, but a full cone spray is not produced.

CITATIONS LIST

Patent Literature

PLT 1. Japanese Patent Publication No. 2005-508741A
PLT 2. Japanese Patent Publication No. 2005-058899A
PLT 3. Japanese Patent Publication No. 2005-052754A

SUMMARY OF INVENTION

Technical Problem

In the process of production of steel sheet, for example, when cooling steel sheet after hot rolling, spray nozzles are used to spray cooling water on the steel sheet.

To use spray nozzles for cooling steel sheet, it is demanded that it be possible to obtain a strong, uniform spray impact and a uniform water flow rate distribution across the entire region being sprayed. If the spray impact is weak, the cooling ability is inferior. If the spray impact and the flow rate distribution are not uniform, over-cooling etc. occur in part of the region of the steel sheet and, as a result, the characteristics of the steel sheet are adversely affected.

Here, the "water flow rate distribution" means the distribution of the flow rate density of fluid per unit area in a spray region on a flat surface when projecting the spray on to a flat surface. Further, the "spray impact" means the pressure of the fluid which strikes a flat surface when the spray is projected onto a flat surface.

The full cone spray nozzle of PLT 1 requires an axial flow by the center bore of the vane structure in order to obtain a uniform water flow rate distribution in a wide angle spray region. However, it is in practice difficult to obtain a uniform water flow rate distribution due to the effects of dimensional tolerances and pressure fluctuations in the liquid. The flow rate of the center part of the spray area easily becomes greater. However, if just using a vane structure which does not have a center bore so as to decrease the flow rate at the center part of a wide angle use spray nozzle, conversely the flow rate near the center part will fall and a uniform spray pattern will no longer be able to be obtained (see FIG. 5C).

The full cone spray nozzle of PLT 2 is one for obtaining a bell-curve type spray pattern. The further from the center, the weaker the spray impact. Therefore, when used for cooling steel sheet, good cooling is not possible.

The nozzle of PLT 3 is one which imparts a swirl force to a low pressure liquid and generates a hollow cone type spray pattern which has a weak spray impact and fine liquid droplets. This cannot be applied for generating a full cone spray by a high pressure liquid with a strong spray impact.

An object of the present invention is to provide a full cone spray nozzle which is suitable for example for cooling steel sheet in the process of production of steel sheet and which has a strong, uniform spray impact across the entire sprayed region even without increasing the inflow pressure.

That is, the object is to realize a nozzle which has the characteristic of the amount of liquid reaching an object (in the case of the present invention, the flat surface to be cooled) per unit area per unit time being substantially constant at the circle at the bottom of the cone. Furthermore, in the nozzle of the present invention, the object is to increase the velocity by which the fluid impacts the object over that of the conventional nozzle, strengthen the spray impact, and improve the cooling ability by the same inflow pressure.

Solution to Problem

The inventors in particular engaged in in-depth studies on a structure of a full cone spray nozzle which gives the necessary spray impact in the spray region required for cooling steel sheet in particular without raising the inflow pressure and furthermore which achieves a uniform water flow rate distribution.

When made a structure with a bore at the center part of the vane structure inside the nozzle, as explained above, the uniformity of the flow rate distribution is not good, so the inventors studied in detail a structure with no bore at the center part of the vane structure. The "vane structure" referred to here is the part 2 which gives swirl at the inside of the nozzle which forms the swirl path 7 which is shown in FIG. 1 or FIG. 3.

When made a structure with no bore at the center part of the vane structure inside the nozzle, as explained above, the flow rate distribution easily becomes an inverted bell curve. However, as a result of studies of the inventors, it was learned that even in a structure with no bore at the center part of the vane structure, by providing channels of a suitable width and depth at the circumference of the vane structure, particularly the downstream side, a full cone spray nozzle which has a spray angle suitable for cooling steel sheet etc. can be obtained.

However, even if simply making the nozzle a structure with no bore at the center part of the vane structure and making the channels around the vane structure suitable sizes, the pressure loss inside of the nozzle is large and a strong spray impact cannot be obtained.

The inventors engaged in further studies. As a result, they learned that by providing a projecting part at the downstream side of the vane structure and, furthermore, setting the swirl flow chamber at the downstream side of the vane structure to a suitable size, it is possible to obtain a full cone spray nozzle which can reduce the pressure loss inside of the nozzle and which can form a spray pattern which has a strong spray impact across a broad range of the spray area without raising the fluid pressure.

Furthermore, they discovered that by making the downstream side projection a combination of a columnar shape and conical shape, it is possible to make the size of the swirl flow chamber more suitable and as a result it is possible to obtain a full cone spray nozzle which can reduce the pressure loss inside the nozzle more and furthermore which can form a spray pattern which has a strong spray impact across a broad range of the spray area.

Note that, sometimes an upstream side projection is provided at the upstream side of the vane structure and sometimes it is not, but from the viewpoint of stabilization of the flow rate, it is understood that it is also possible to provide the upstream side projection at the upstream side of the vane structure.

The present invention was made based on the above findings and has as its gist the following:

(1) A full cone spray nozzle comprising:

a nozzle body having a fluid inlet at an upstream end and a spray orifice at a downstream end;

a vane structure of an axial direction length W and diameter D arranged at an intermediate position inside of the nozzle body so that an outer circumferential surface contacts the inside of the nozzle body;

a plurality of channel grooves of a width T and a depth H in an outer circumferential surface of the vane structure;

a downstream side projecting part at a downstream side of the vane structure; and a swirl flow chamber of axial direction length L which is a space formed by an inside wall surface of the nozzle body, the vane structure, and the spray orifice, wherein $0.25 \leq T/D \leq 0.30$, $0.25 \leq H/D \leq 0.30$, and $1.5 \leq L/W \leq 3.5$ are satisfied.

(2) The full cone spray nozzle of (1) wherein the swirl flow chamber is comprised a columnar shaped region of an axial direction length L1 from the vane structure and a conically shaped region of an axial direction length L2 and vertical angle δ at its downstream side, the downstream side projecting part is comprised of a columnar shaped region of an axial direction length P1 from the vane structure and a conically shaped region of an axial direction length P2 and vertical angle δP at its downstream side, and the nozzle satisfies $\delta P/\delta \geq 0.5$ and $0.2 \leq L1/D \leq 0.9$.

(3) The full cone spray nozzle of (1) or (2) wherein the axial direction length P of the downstream side projecting part, the axial direction length P2 of the conically shaped region of the downstream side projecting part, the axial direction length L of the swirl flow chamber, and the axial direction length L2 of the conically shaped region of the swirl flow chamber satisfy $0.3 \leq P/L \leq 0.9$ and $0.2 \leq P2/L2 \leq 0.9$.

Advantageous Effects of Invention

According to the present invention, it is possible to obtain a spray nozzle which reduces the pressure loss of the liquid in the nozzle body and can spray liquid efficiently by a strong uniform spray impact.

DESCRIPTION OF EMBODIMENTS

Below, embodiments of the present invention will be explained with reference to the drawings. Note that elements which have substantially the same functions and configurations will be assigned the same reference signs and overlapping explanations will be omitted.

Figure 1:
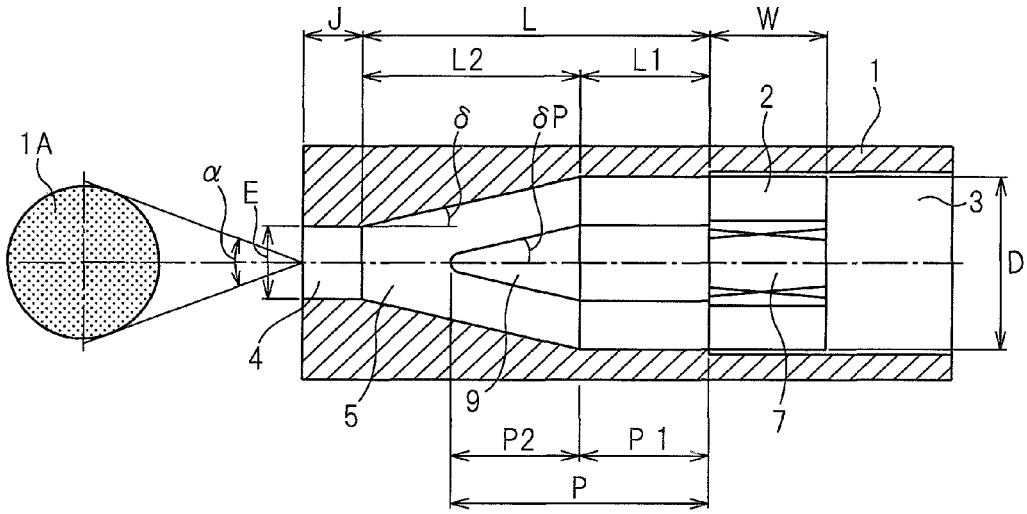
FIG. 1 is a view which shows an outline of the full cone spray nozzle of the present invention, wherein (a) is an example where a projection is provided at only the downstream side of the vane structure and (b) is an example where projections are provided at the downstream side and upstream side of the vane structure.
Figure 1:
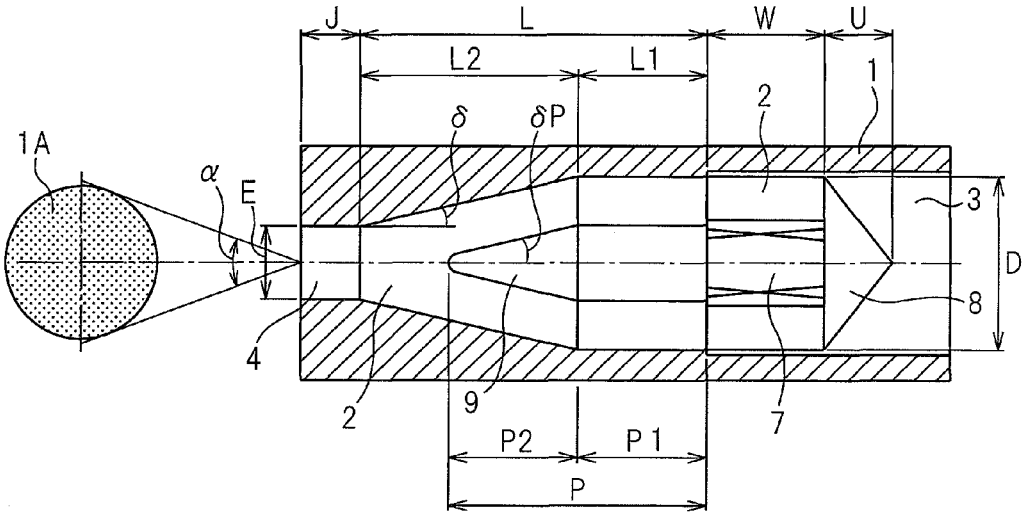
Figure 2:
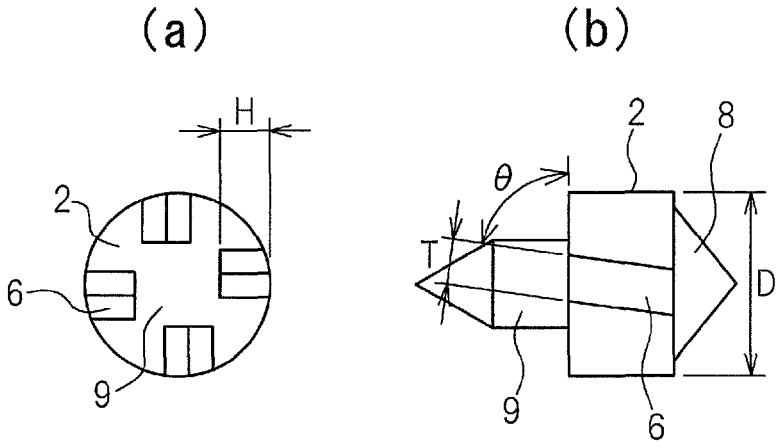
FIG. 2 is a view which shows an outline of a vane structure of the full cone spray nozzle of the present invention where projections are provided at the downstream side and upstream side, wherein (a) is a plan view of the downstream side and (b) is a side view.

FIG. 1 and FIG. 2 show the basic configuration of a full cone spray nozzle of the present invention. FIG. 1 shows an outline of the full cone spray nozzle of the present invention as a whole. A projection is provided at the downstream side of the vane structure. The upstream side of the vane structure may either not have a projection such as in (a) or may have a projection such as in (b). FIG. 2 shows an outline of vane structure at which projections are provided at the upstream side and the downstream side.

The full cone spray nozzle of the present invention is comprised of a substantially tubular nozzle body 1 and a vane structure 2 of an axial direction length W and diameter D which is provided at a substantially intermediate position inside of the nozzle body 1 and forms a liquid flow.

At the upstream end of the nozzle body 1, a fluid inlet 3 is arranged, while at the downstream end, a spray orifice 4 of an axial direction length J and opening E is arranged on the same axis.

The nozzle body 1 is divided by the vane structure 2 into an upstream side and a downstream side. The vane structure 2 contacts the nozzle body 1 at the inside and is provided with an upstream side projecting part 8 of an axial direction length U at the upstream side and a downstream side projecting part 9 of an axial direction length P at the downstream side.

The upstream side projecting part 8 and the downstream side projecting part 9 can be shaped as, for example, conical shapes or frustum of cone shapes or combined shapes of these and columnar shapes.

In the example which is shown in FIG. 1 and FIG. 2, the downstream side projecting part 9 is shaped as a combined shape of a length P1 columnar shape and P2 conical shape. The shape of the projecting part is not limited to these, but these shapes are suitable for obtaining the flow rate distribution which the present invention targets.

At the outer circumferential surface of the vane structure 2, a plurality of channel grooves 6 of width T and depth H are provided. These form a swirl path 7 which is defined together with the inner circumferential wall surface of the bore of the nozzle body 1 which closes the outer circumferential surface of the vane structure 2.

The axial direction length L space which is surrounded by the vane structure 2, inside wall surface of the nozzle body 1, and spray orifice 4 forms the swirl flow chamber 5. Liquid which flows in from the fluid inlet 3 of the nozzle body 1 passes through the swirl path 7 and flows into the swirl flow chamber 5.

The spray orifice 4 is smaller in diameter than the inside diameter of the nozzle body 1, so the swirl flow chamber is reduced in diameter toward the spray orifice 4. As examples of the shape of the swirl flow chamber 5, a conical shape or frustum of cone shape or a combined shape of these and a columnar shape may be mentioned.

The example which is shown in FIG. 1 shows a swirl flow chamber 5 of a shape of a combination of a columnar shape of a length L1 and a conical shape of a length L2. The shape of the swirl flow chamber 5 is not limited to this, but this shape is suitable for obtaining the flow rate distribution which the present invention targets.

The liquid which is made to swirl in the swirl flow chamber 5 passes through the spray orifice 4 and is atomized. The spray orifice 4 may be one which increases in diameter the further to the downstream side or one which is the same diameter overall.

The channel grooves 6 which serve as the swirl path 7 are formed in a multiple number at intervals in the outer circumference of the vane structure 2. The channel grooves 6 are not parallel with the center axis of the nozzle, but have a slant of an inclination angle θ with respect to the circumferential direction. For this reason, the liquid which passes through the swirl path 7 and flows into the swirl flow chamber 5 becomes a swirl flow.

The number of the channel grooves 6 is not particularly limited, but can be made 3 to 6 or so. The inclination angle θ is not particularly prescribed and can be suitably changed according to the required spray impact, flow rate, etc. The smaller the θ, the wider the spray angle α. When making the spray angle α the 20 to 40° suitable for cooling steel sheet, it is generally 60 to 89°, preferably 70 to 85°.

At the upstream side of the vane structure 2, an upstream side projecting part 8 is provided. Due to this, the liquid which flows in from the fluid inlet is straightened in flow and the pressure loss can be reduced.

The liquid which is sprayed from the spray orifice 4 by a spray angle α forms a full cone shaped spray pattern 1A.

Figure 3:
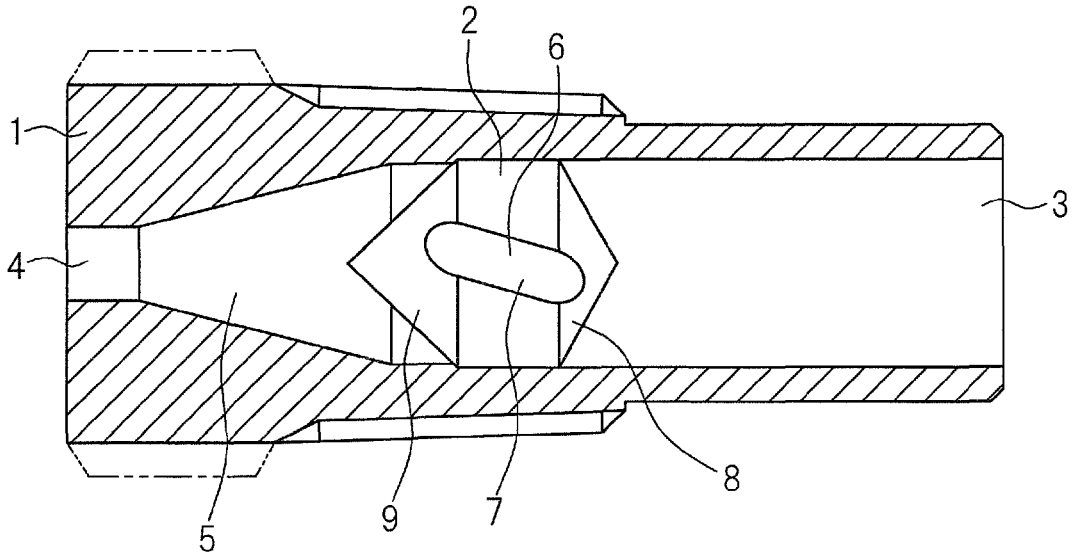
FIG. 3 is a view which shows an outline of another embodiment of the full cone spray nozzle of the present invention.

FIG. 3 is a view which shows an outline of another example of the full cone spray nozzle of the present invention. The shape of the downstream side projecting part 9 is made a conical shape. In the full cone spray nozzle of FIG. 3 as well, the uniformity of the spray pattern and impact can be improved over the conventional nozzle, but the advantageous effect is smaller compared with a nozzle having a columnar part in the downstream side projection.

When using a full cone spray nozzle in the cooling process in the manufacture of steel sheet, the larger the spray impact, the greater the cooling effect. Further, if overcooling occurs in only part of the steel sheet, this will lead to deterioration of the characteristics of the steel sheet, so a uniform flow rate distribution at the spray surface (meaning one within ±5%) is sought.

In cooling steel sheet, usually a spray nozzle which has a spray orifice of a diameter ϕ1 to 10 mm or so is used to spray cooling water on steel sheet about 50 to 1000 mm in front of the spray orifice by a spray angle of 5 to 50° or so for cooling.

The inventors studies the inside shapes of nozzles so as to establish a suitable flow inside the nozzles and thereby reduce the pressure loss and as a result discovered that by suitably setting the width and depth of the channel grooves which are provided at the vane structure, it is possible to keep the pressure loss low and obtain a uniform flow rate distribution which has a strong spray impact.

That is, the fact that by suitably setting the ratio of the channel width T and depth H, it is possible to reduce the pressure loss and strengthen the eddy flow was discovered by the inventors. Specifically, if using wide, shallow grooves or narrow, deep grooves, the resistance which the fluid receives from the walls becomes greater and the pressure loss becomes larger, so the velocity of the fluid is weakened and as a result the eddy flow becomes weaker.

The inventors first took note of the swirling force of the liquid which flows into the swirl chamber and discovered that by making the width T and depth H of the channel grooves 0.25 to 0.30 time the diameter D of the vane structure, a uniform flow rate distribution can be obtained. If the width T or depth H becomes less than 0.25 time the diameter D, the flow rate at the center part of the spray surface decreases, a ring-shaped flow rate distribution results, and, for example, when used for cooling steel sheet, uniform cooling becomes no longer possible.

If the width T or depth H exceeds 0.30 time the diameter D, the flow rate at the center part becomes extremely large. In this case as well, uniform cooling no longer becomes possible. As opposed to this, as in the present invention, if making the width T and depth H 0.25 to 0.30 time the diameter D, a uniform flow rate distribution is obtained over the entire area of the spray surface.

Furthermore, the inventors discovered that to reduce the pressure loss inside of the nozzle and improve the spray impact, it is necessary to make the ratio L/W of the axial direction length L of the swirl flow chamber to the axial direction length W of the vane structure 1.5 to 3.5. Due to this, it was possible to sufficiently promote the swirling state of the flow after the vane structure and possible to obtain a uniform water flow rate distribution.

If L/W is less than 1.5, the flow straightening effect in the swirl flow chamber becomes smaller, the swirling state becomes insufficient, and a bell-curve shape water flow rate distribution results. If L/W exceeds 3.5, the distance of advance of the liquid after passing the vane structure becomes longer, the pressure loss in the nozzle increases and the spray impact falls. The more preferable range of L/W is 1.9 to 3.1.

To reduce the pressure loss, more preferably the swirl flow chamber should be made a shape which is provided with a columnar shaped region of an axial direction length L1 and unchanging diameter from the vane structure and a conically shaped region of an axial direction length L2 and a vertical angle δ at its downstream side. Furthermore, the downstream side projecting part should be made a shape which is provided with a columnar shaped region of an axial direction length P1 and unchanging diameter from the vane structure and a conically shaped region of an axial direction length P2 and a vertical angle δP at its downstream side.

This columnar shaped region renders the flow of the fluid which was made to swirl by the vane structure free of turbulence, that is, a straightened flow state, and then makes the fluid move to the conically shaped region, so can reduce the pressure loss. In particular, if there is no columnar shaped region, it is possible to prevent flow motion occurring at the downstream side center part of the vane structure and possible to reduce the pressure loss due to this flow motion. In this columnar shaped region, it is preferable that the walls of the swirl chamber and the columnar shape projection be parallel.

Further, by making the shape one which satisfies $\delta P/\delta \leq 0.5$ and $0.2 \leq L1/D \leq 0.9$, it is possible to more effectively reduce the pressure loss and obtain a strong spray impact. If δP/P becomes smaller, the swirl flow becomes weaker and water flow rate distribution easily becomes a bell-curve shape. If L1/D is less than 0.2, the flow straightening effect in the swirl flow chamber becomes smaller, the swirling state becomes insufficient, and a bell-curve shape water flow rate distribution results. If L1/D exceeds 0.9, the distance of advance of the liquid after passing the vane structure becomes longer, so the pressure loss in the nozzle increases and the spray impact falls.

More preferably, the shape is one where the length P of the downstream side projecting part, the length P2 of the conically shaped region of the downstream side projecting part, the length L of the swirl flow chamber, and the length L2 of the conically shaped region of the swirl flow chamber satisfy $0.3 \leq P/L \leq 0.9$ and $0.2 \leq P2/L2 \leq 0.9$. If P/L is less than 0.3, flow motion occurs due to the peeling of the flow near the P2 part, the pressure loss in the nozzle increases, and the spray impact falls. If P/L exceeds 0.9, the swirl flow becomes excessive and an inverted bell-curve shape water flow rate distribution results. If P2/L2 is less than 0.2, flow motion occurs due to the peeling of the flow near the P2 part, the pressure loss in the nozzle increases, and the spray impact falls. If P2/L2 exceeds 0.9, the swirl flow becomes excessive, and an inverted bell-curve shape water flow rate distribution results. Due to this, it is possible to more effectively reduce the pressure loss and to obtain a uniform water flow rate distribution and strong spray impact.

The spray nozzle of the present invention is particularly suitable if used as a spray nozzle for cooling steel sheet which cools steel sheet using cooling water, but is not limited to this application. For example, it can also be suitably used for cleaning electronic parts or mechanical parts etc.

EXAMPLES

Example 1

To confirm the advantageous effects of the full cone spray nozzle of the present invention, fluid analysis was performed. The parameters of the nozzles which were used for calculation are shown in Table 1. No. 11 to 14 and 16 are full cone spray nozzles of the present invention where projections are provided at the downstream side of the vane structure, while No. 15 is a full cone spray nozzle of the conventional type where a projection is not provided at the vane structure. No. 16 is further provided with a projection at the upstream side of the vane structure.

TABLE 1

| No. | D [mm] | U [mm] | W [mm] | L [mm] | L1 [mm] | L2 [mm] | P [mm] | P1 [mm] | P2 [mm] | J [mm] | E [mm] | δ [°] | δP [°] | T [mm] | H [mm] | θ [°] | Remarks |
|---|---|---|---|---|---|---|---|---|---|---|---|---|---|---|---|---|---|
| 11 | 36.0 | 0 | 24.0 | 72.0 | 26.8 | 45.2 | 56.2 | 29.9 | 26.3 | 12.6 | 14.6 | 13.5 | 13.5 | 9.7 | 10.1 | 84.0 | Inv. ex. |
| 12 | 38.1 | 0 | 24.0 | 72.1 | 27.0 | 45.1 | 53.6 | 27.0 | 26.6 | 12.9 | 14.6 | 13.5 | 13.5 | 10.3 | 10.7 | 84.0 | Inv. ex. |
| 13 | 38.4 | 0 | 23.8 | 45.4 | 0.0 | 45.4 | 29.6 | 3.1 | 26.5 | 12.5 | 14.6 | 13.5 | 13.5 | 10.4 | 10.8 | 84.0 | Inv. ex. |
| 14 | 38.1 | 0 | 24.0 | 72.4 | 27.1 | 45.3 | 50.6 | 24.0 | 26.6 | 12.8 | 14.6 | 13.5 | 13.5 | 10.3 | 10.7 | 84.0 | Inv. ex. |
| 15 | 38.1 | 0 | 24.1 | 72.1 | 26.8 | 45.3 | — | — | — | 12.6 | 14.6 | 13.5 | — | 10.3 | 10.7 | 84.0 | Comp. Ex. |
| 16 | 36.0 | 13.0 | 24.0 | 72.0 | 26.8 | 45.2 | 56.2 | 29.9 | 26.3 | 12.6 | 14.6 | 13.5 | 13.5 | 9.7 | 10.1 | 84.0 | Inv. ex. |

| No. | T/D | H/D | L/W | δP/δ | L1/D | P/L | P2/L2 | Remarks |
|---|---|---|---|---|---|---|---|---|
| 11 | 0.27 | 0.28 | 2.99 | 1.0 | 0.74 | 0.78 | 0.58 | Inv. ex. |
| 12 | 0.27 | 0.28 | 3.01 | 1.0 | 0.71 | 0.74 | 0.59 | Inv. ex. |
| 13 | 0.27 | 0.28 | 1.91 | 1.0 | 0.0 | 0.65 | 0.58 | Inv. ex. |
| 14 | 0.27 | 0.28 | 3.02 | 1.0 | 0.71 | 0.70 | 0.59 | Inv. ex. |
| 15 | 0.27 | 0.28 | 2.99 | 1.0 | 0.70 | — | — | Comp. Ex. |
| 16 | 0.27 | 0.28 | 2.99 | 1.0 | 0.74 | 0.78 | 0.58 | Inv. ex. |

Figure 4:
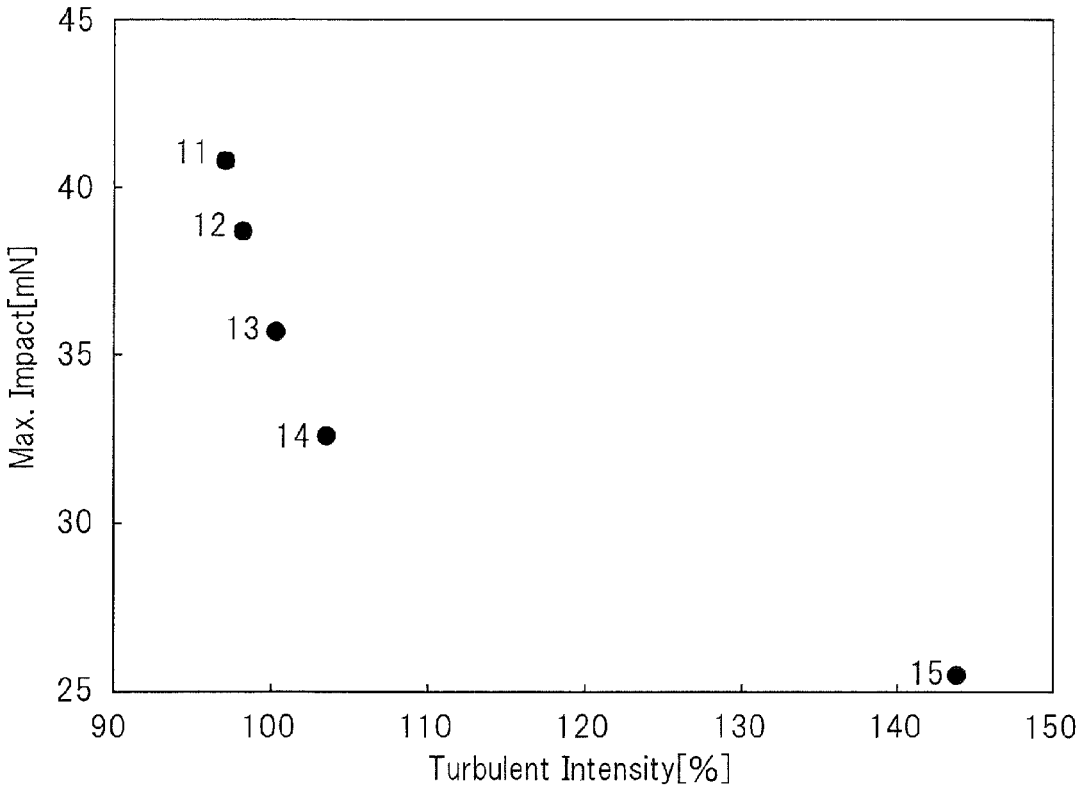
FIG. 4 is a view which shows the relationship between the turbulent intensity in the nozzle and the spray impact in examples of the full cone spray nozzle of the present invention.
Figure 5:
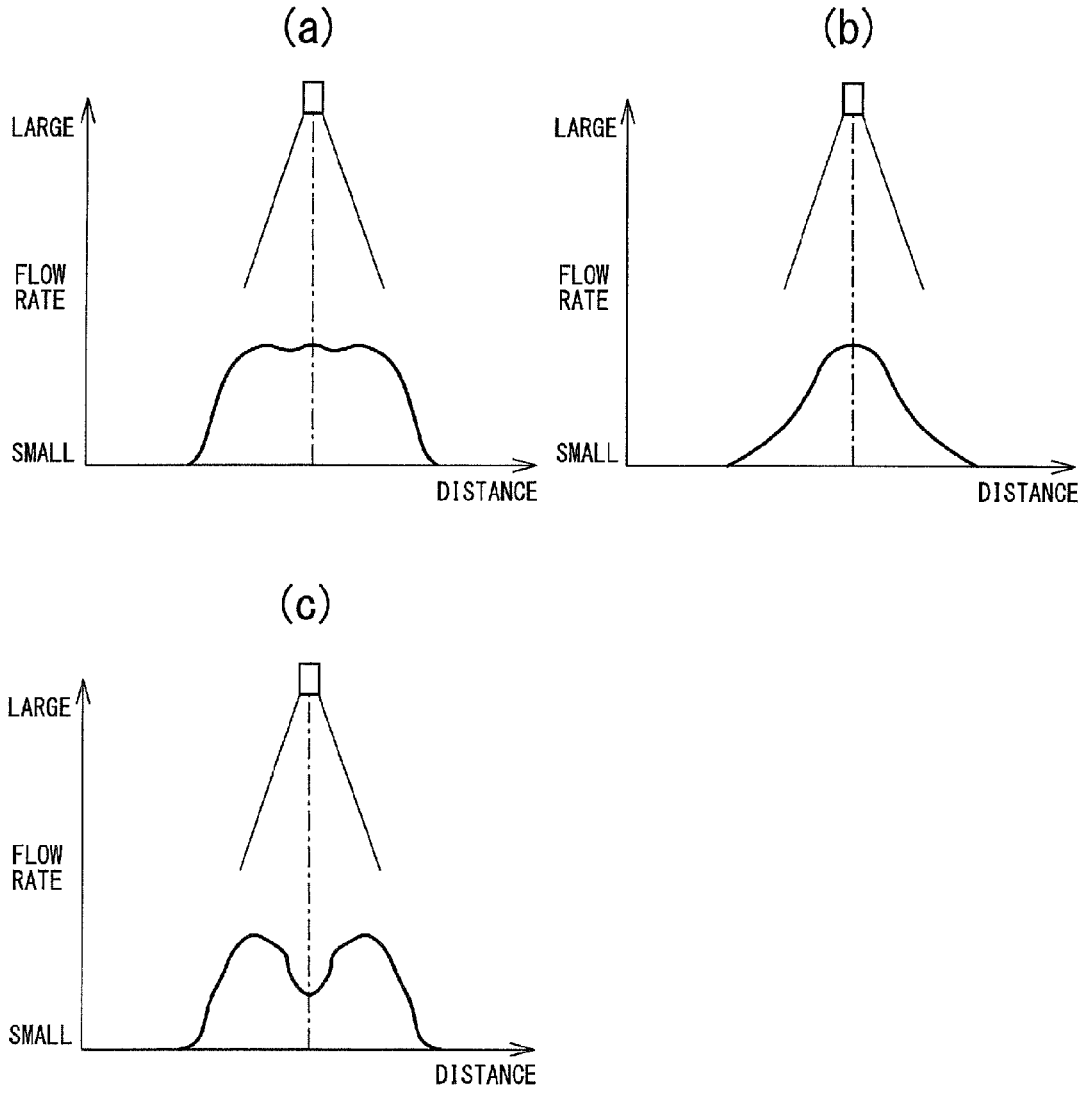
FIG. 5 is a view which shows an outline of the flow rate distribution in a diametrical direction of the spray region, wherein (a) shows the ideal distribution according to the full cone spray nozzle of the present invention, (b) shows a distribution with a large flow rate near the center part, and (c) shows the distribution with a small flow rate near the center part.

The relationship between the spray impact at the spray orifice of the full cone spray nozzles which were analyzed at a fixed spray pressure and the turbulent intensity is shown in FIG. 4. The numbers in the figure correspond to the numbers in Table 1. Note that No. 16 as well, which provides a projection at the upstream side of the vane structure of No. 11, had a flow rate characteristic and spray impact characteristic similar to No. 11.

Here, the "spray impact" was made the impact right under the nozzle at the time of spray height of 300 mm.

As shown in FIG. 4, it is learned that when making the diameters of the spray orifices of the nozzles the same, if the turbulent intensity (FIG. 4) is 110% or less (that is, about 80% of the conventional type full cone spray nozzle or less), the spray impact (in FIG. 4, Impact Max) becomes 1.2 times or more that of the conventional nozzle. Here, the "conventional type full cone spray nozzle" means a nozzle without a projection at the downstream side of the vane structure.

The "turbulent intensity" is the value which is calculated by using a hot wire flowmeter etc. to obtain the time series data of fluctuation of speed and calculate the average speed, then subtracting the average value from the time series data, squaring that value, then finding the average value of the squared value and the square root.

As the value of the turbulent intensity, the average value of the turbulent intensity at the part of the spray orifice 4 of the nozzle which is close to the atmosphere side was used. The turbulent intensity was calculated using the results of fluid analysis utilizing the CFD (Computational Fluid Dynamics) software "ANSYS Fluent" (made by ANSYS) which is based on the finite volume method.

From the above results, according to the full cone spray nozzle of the present invention, no turbulence occurs in the spray and the pressure loss is small, so it was confirmed that even if not increasing the spray pressure, a 25% or stronger spray impact is obtained compared with the conventional type full cone spray nozzle.

On the other hand, the conventional type full cone spray nozzle, compared with the full cone spray nozzle of the present invention, has a larger turbulent intensity inside the nozzle and a smaller spray impact at the spray orifice in the results.

Note that, the dimensions of the spray nozzle of the present invention are not limited to those which are shown in Table 1. It is sufficient that the conditions of T/D, H/D, and L/W which are prescribed by the present invention be satisfied. For example, as shown in Table 2, the diameter E of the spray orifice may also be different.

Example 2

Using the nozzle of No. 11 of Table 1 as the basis, the ratios T/D and H/D of the width T and depth H of the channel grooves at the outer circumference of the vane structure to the diameter D of the vane structure were changed in various ways. The spray impact when making the spray angle a fixed 30° was evaluated. Here, the "flow rate distribution" is assumed to mean the ratio of the diameter of the part where the flow rate becomes 50% when assuming the point at the spray surface of a range of spray angle 30° where the flow rate becomes maximum as 100% and the diameter of the spray surface which is determined geometrically by the nozzle height and spray opening.

Figure 6:
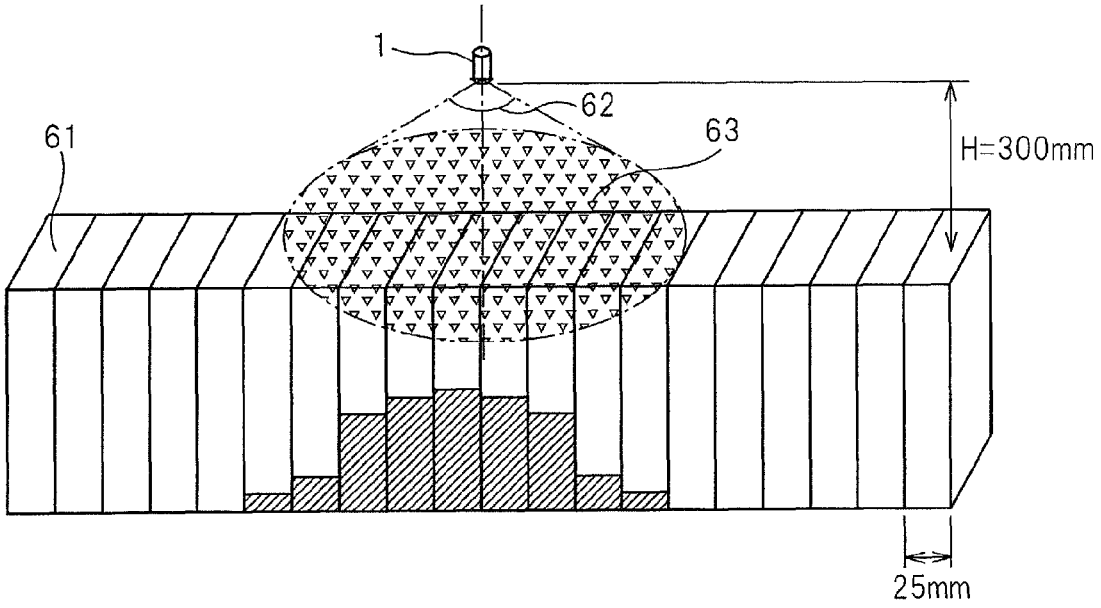
FIG. 6 is a view which shows an outline of measurement of the water flow rate distribution of a full cone spray nozzle.

The flow rate distribution was measured by using a measurement apparatus having a spray height of 300 mm, a spray pressure of 0.3 MPa, a water flow of 13.1 liter/min, and measurement units of 25 mm in the diametrical direction. FIG. 6 is a view which shows an outline of measurement of flow rate distribution. Note that, when divided into 25 mm units, the parts of one unit to several units to the two sides are regions corresponding to the far edges of the flow rate distribution, so these parts are excluded from the region for evaluation of uniformity of the flow rate distribution.

The present example was evaluated by ranking an experiment with a diameter ratio of 80% or more as "A", one of 70% to less than 80% as "B", one of 50% to less than 70% as "C", and one of less than 50% as "D". A flow rate distribution of 70% or more is preferable from the viewpoint of the uniformity of spray impact while one of 80% or more is more preferable.

As shown in Table 3, when T/D and H/D are 0.25 to 0.30, a good flow rate distribution was obtained. In particular, when 0.27 to 0.28, extremely good results were obtained.

TABLE 3

| | T/D | H/D | Evaluation |
|---|---|---|---|
| Experiment 31 | 0.27 | 0.28 | A |
| Experiment 32 | 0.30 | 0.25 | B |
| Experiment 33 | 0.25 | 0.30 | B |
| Comparative Example 34 | 0.15 | 0.28 | C |
| Comparative Example 35 | 0.27 | 0.15 | C |
| Comparative Example 36 | 0.45 | 0.28 | D |
| Comparative Example 37 | 0.27 | 0.40 | D |

TABLE 2

| No. | D [mm] | U [mm] | W [mm] | L [mm] | L1 [mm] | L2 [mm] | P [mm] | P1 [mm] | P2 [mm] | J [mm] | E [mm] | δ [°] | δP [°] | T [mm] | H [mm] | θ [°] | Remarks |
|---|---|---|---|---|---|---|---|---|---|---|---|---|---|---|---|---|---|
| 21 | 37.0 | 0 | 24.7 | 74.0 | 27.5 | 46.4 | 57.7 | 30.7 | 27.0 | 12.9 | 15.0 | 13.5 | 13.5 | 10.0 | 10.4 | 84 | Inv. ex. |
| 22 | 26.1 | 8.9 | 16.4 | 49.4 | 18.5 | 30.9 | 36.7 | 18.5 | 18.2 | 8.8 | 10.0 | 13.5 | 13.5 | 7.1 | 7.3 | 84 | Inv. ex. |
| 23 | 52.6 | 17.8 | 32.6 | 62.2 | 0 | 62.2 | 40.5 | 4.2 | 36.3 | 17.1 | 20.0 | 13.5 | 13.5 | 14.2 | 14.8 | 84 | Inv. ex. |
| 24 | 65.2 | 22.3 | 41.1 | 124.0 | 46.4 | 77.6 | 86.6 | 41.1 | 45.5 | 21.9 | 25.0 | 13.5 | 13.5 | 17.6 | 18.3 | 84 | Inv. ex. |
| 25 | 39.1 | 13.4 | 24.8 | 74.1 | 27.5 | 46.5 | — | — | — | 12.9 | 15.0 | 13.5 | — | 10.6 | 11 | 84 | Comp. Ex. |

| No. | T/D | H/D | L/W | δP/δ | L1/D | P/L | P2/L2 | Remarks |
|---|---|---|---|---|---|---|---|---|
| 21 | 0.27 | 0.28 | 2.99 | 1.0 | 0.74 | 0.78 | 0.58 | Inv. ex. |
| 22 | 0.27 | 0.28 | 3.01 | 1.0 | 0.71 | 0.74 | 0.59 | Inv. ex. |
| 23 | 0.27 | 0.28 | 1.91 | 1.0 | 0.0 | 0.65 | 0.58 | Inv. ex. |
| 24 | 0.27 | 0.28 | 3.02 | 1.0 | 0.71 | 0.70 | 0.59 | Inv. ex. |
| 25 | 0.27 | 0.28 | 2.99 | 1.0 | 0.70 | — | — | Comp. Ex. |

Example 3

Using the nozzle of No. 11 of Table 1 as the basis, the ratio L/W of the length L of the swirl flow chamber to the length W of the axial direction of the vane structure was changed in various ways. The spray impact when making the spray angle a fixed 30° was evaluated.

Figure 7:
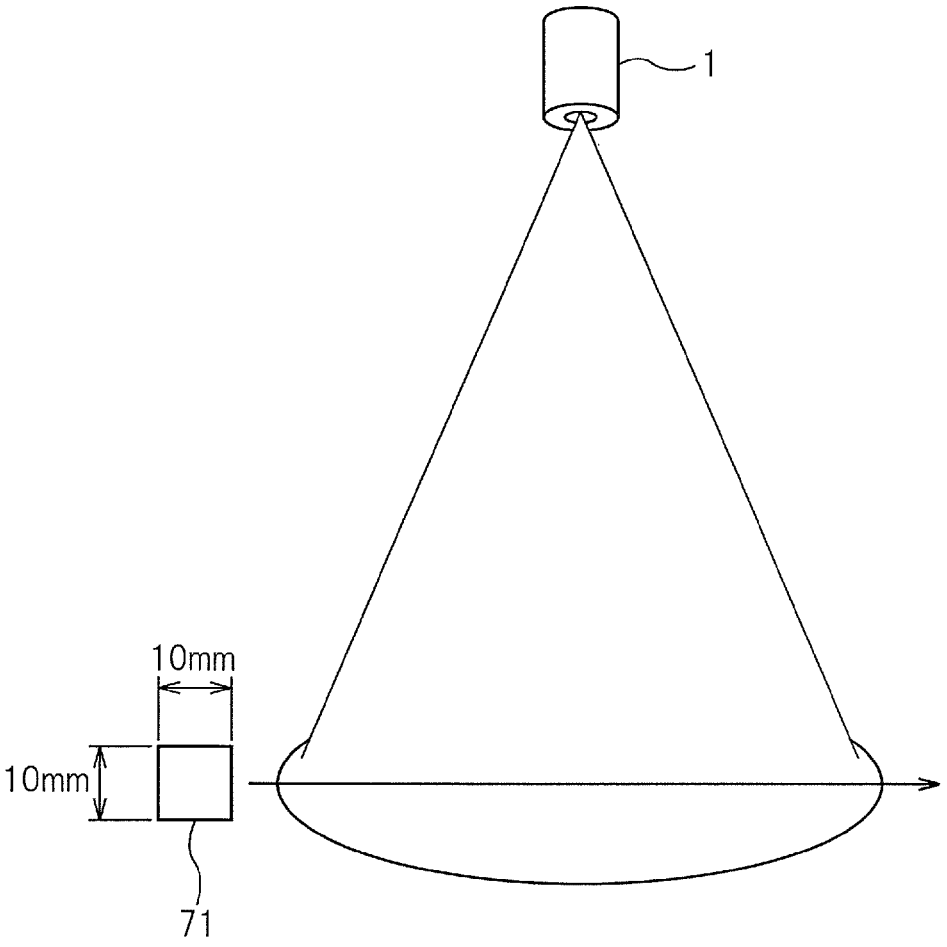
FIG. 7 is a view which shows an outline of measurement of spray impact of a full cone spray nozzle.

Here, the spray impact was measured by using an impact sensor having a spray outlet height of 300 mm, and a 10 mm square pressure sensing part right under the nozzle. FIG. 7 shows an outline of measurement of spray impact. Here, the spray impact is found by measuring the impact pressure while making the pressure sensing part move along the line passing through the center part of the cone. The spray impact value does not appear as just a single point sticking out, so the maximum value is used as the representative value.

The spray impact was evaluated by setting the value of the conventional type full cone nozzle spray which is shown in No. 15 of Table 1 as "1", evaluating an experiment with a ratio to the same of 1.3 or more as "A", one of 1.2 to less than 1.3 as "B", one of 1.05 to less than 1.2 as "C", and one of less than 1.05 as "D".

As shown in Table 4, when L/W is 1.5 to 3.5, a strong spray impact was obtained. In particular, when 1.9 to 3.1, extremely good results were obtained.

TABLE 4

| | L/W | Evaluation |
|---|---|---|
| Experiment 41 | 2.6 | A |
| Experiment 42 | 3.1 | A |
| Experiment 43 | 1.9 | A |
| Experiment 44 | 1.5 | B |
| Experiment 45 | 3.5 | B |
| Comparative Example 46 | 1.2 | C |
| Comparative Example 47 | 4.0 | D |

Example 4

Using the nozzle of No. 11 of Table 1 as the basis, the ratio of the vertical angle δ of the swirl flow chamber and the vertical angle δP of the projection and the ratio of the length L1 of the columnar shaped region of the swirl flow chamber to the diameter D of the vane structure was changed in various ways. The spray impact when making the spray angle a fixed 30° was evaluated. The method of measurement of the spray impact was made the same as Example 3.

The spray impact was evaluated by setting the value of the conventional type full cone nozzle spray which is shown in No. 15 of Table 1 as "1", evaluating an experiment with a ratio to the same of 1.2 or more as "A", one of 1.2 or less as "B", one of 1.05 to less than 1.2 as "C", and one of less than 1.05 as "D".

As shown in Table 5, when δP/δ is 0.5 or more and when L1/D is 0.2 to 0.9, particularly good results were obtained.

TABLE 5

| | δP/δ | L1/D | Evaluation |
|---|---|---|---|
| Experiment 51 | 1.0 | 0.7 | A |
| Experiment 52 | 0.5 | 0.9 | A |
| Experiment 53 | 1.5 | 0.2 | A |
| Experiment 54 | 0.3 | 0.6 | B |
| Experiment 55 | 1.0 | 0.15 | B |

TABLE 5-continued

| | δP/δ | L1/D | Evaluation |
|---|---|---|---|
| Experiment 56 | 1.0 | 1.0 | B |
| Example 57 | 1.0 | 0 | B |

Example 5

Using the nozzle of No. 11 of Table 1 as the basis, the ratio P/L of the length P of the downstream side projecting part to the length L of the swirl flow chamber and the ratio P2/L2 of the length P2 of the conically shaped region of the downstream side projecting part to the length L2 of the conically shaped region of the swirl flow chamber were changed in various ways. The spray impact when making the spray angle a fixed 30° was evaluated. The method of measurement of the spray impact was made one similar to Example 3.

The spray impact was evaluated by setting the value of the conventional type full cone nozzle spray which is shown in No. 15 of Table 1 as "1", evaluating an experiment with a ratio to the same of 1.2 or more as "A", one of 1.2 or less as "B", one of 3 or more as "A", one of 1.2 to less than 1.3 as "B", one of 1.05 to less than 1.2 as "C", and one of less than 1.05 as "D".

As shown in Table 6, when P/L is 0.3 to 0.9 and P2/L2 is 0.2 to 0.9, particularly good results were obtained.

TABLE 6

| | P/L | P2/L2 | Evaluation |
|---|---|---|---|
| Experiment 61 | 0.2 | 0.6 | B |
| Experiment 62 | 0.3 | 0.15 | B |
| Experiment 63 | 0.3 | 0.2 | A |
| Experiment 64 | 0.3 | 0.6 | A |
| Experiment 65 | 0.3 | 0.9 | A |
| Experiment 66 | 0.3 | 0.95 | B |
| Experiment 67 | 0.6 | 0.15 | B |
| Experiment 68 | 0.6 | 0.2 | A |
| Experiment 69 | 0.6 | 0.6 | A |
| Experiment 70 | 0.6 | 0.9 | A |
| Experiment 71 | 0.6 | 0.95 | B |
| Experiment 72 | 0.9 | 0.15 | B |
| Experiment 73 | 0.9 | 0.2 | A |
| Experiment 74 | 0.9 | 0.6 | A |
| Experiment 75 | 0.9 | 0.9 | A |
| Experiment 76 | 0.9 | 0.95 | B |
| Experiment 77 | 0.95 | 0.6 | B |

INDUSTRIAL APPLICABILITY

According to the present invention, a full cone spray nozzle which has little pressure loss and sprays a liquid efficiently in a full cone shape which has a uniform flow rate distribution is obtained. The full cone spray nozzle of the present invention is suitable for cooling in the process of production of steel sheet. Its industrial applicability is great.

REFERENCE SIGNS LIST

1 nozzle body
1A spray pattern
2 vane structure
3 fluid inlet
4 spray orifice
5 swirl flow chamber
6 channel groove

7 swirl path
8 upstream side projecting part
9 downstream side projecting part
61 measurement unit
62 spray angle
63 spray surface
71 impact sensor
D diameter of vane structure
H depth of channel groove
T width of channel groove
$\alpha$ spray angle
$\theta$ inclination angle of channel groove

The invention claimed is:

1. A full cone spray nozzle comprising:

a nozzle body having a fluid inlet at an upstream end and a spray orifice at a downstream end and an inner surface;

a vane structure of an axial direction length W and diameter D arranged at an intermediate position inside of the nozzle body so that an outer circumferential surface contacts the inner surface of the nozzle body, the vane structure dividing the nozzle body into an upstream side and a downstream side;

a plurality of channel grooves of a width T and a depth H in an outer circumferential surface of said vane structure;

a downstream side projecting part connected to a downstream side of said vane structure, the downstream side projecting part being spaced from the inner surface of the nozzle body; and a swirl flow chamber of an axial direction length L which is a space formed by the inner surface of said nozzle body, said vane structure, and said spray orifice, wherein $0.25 \leq T/D \leq 0.30$, $0.25 \leq H/D \leq 0.30$, and $1.5 \leq L/W \leq 3.5$ are satisfied.

2. The full cone spray nozzle as set forth in claim 1 wherein said swirl flow chamber is comprised a columnar shaped region of an axial direction length L1 from said vane structure and a conically shaped region of an axial direction length L2 and vertical angle $\delta$ at its downstream side, said downstream side projecting part is comprised of a columnar shaped region of an axial direction length P1 from said vane structure and a conically shaped region of an axial direction length P2 and vertical angle $\delta$P at its downstream side, and the nozzle satisfies $\delta P/\delta \geq 0.5$ and $0.2 \leq L1/D \leq 0.9$.

3. The full cone spray nozzle as set forth in claim 1, wherein said swirl flow chamber is comprised a columnar shaped region of an axial direction length L1 from said vane structure and a conically shaped region of an axial direction length L2, wherein said downstream side projecting part is comprised of a columnar shaped region of an axial direction length P1 from said vane structure and a conically shaped region of an axial direction length P2, and wherein an axial direction length P of said downstream side projecting part, the axial direction length P2 of said conically shaped region of said downstream side projecting part, the axial direction length L of said swirl flow chamber, and the axial direction length L2 of said conically shaped region of said swirl flow chamber satisfy $0.3 \leq P/L \leq 0.9$ and $0.2 \leq P2/L2 \leq 0.9$.

4. The full cone spray nozzle as set forth in claim 2, wherein an axial direction length P of said downstream side projecting part, the axial direction length P2 of said conically shaped region of said downstream side projecting part, the axial direction length L of said swirl flow chamber, and the axial direction length L2 of said conically shaped region of said swirl flow chamber satisfy $0.3 \leq P/L \leq 0.9$ and $0.2 \leq P2/L2 \leq 0.9$.

5. The full cone spray nozzle as set forth in claim 1, wherein the vane structure has a first end and a second end, wherein the downstream side projecting part has a first end connected to the second end of the vane structure, and wherein a diameter of the second end of the vane structure is larger than a diameter of the first end of the downstream side projecting part.

6. The full cone spray nozzle as set forth in claim 1, wherein the downstream side projecting part has a cylindrical portion extending from the vane structure and a conical portion extending from the cylindrical portion.

* * * * *